US010617919B2

(12) United States Patent
Ines

(10) Patent No.: US 10,617,919 B2
(45) **Date of Patent: *Apr. 14, 2020**

(54) WEIGHTED IRON SET

(71) Applicant: Acushnet Company, Fairhaven, MA (US)

(72) Inventor: Marni D. Ines, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,375

(22) Filed: Jul. 18, 2018

(65) Prior Publication Data

US 2018/0326264 A1 Nov. 15, 2018

Related U.S. Application Data

(63) Continuation of application No. 15/467,644, filed on Mar. 23, 2017, now Pat. No. 10,052,534.

(51) Int. Cl.

| | |
|---|---|
| ***A63B 53/04*** | (2015.01) |
| ***A63B 60/02*** | (2015.01) |
| *A63B 53/00* | (2015.01) |
| *A63B 53/02* | (2015.01) |

(52) U.S. Cl.

CPC ..... *A63B 53/047* (2013.01); *A63B 53/0475* (2013.01); *A63B 60/02* (2015.10); *A63B 53/02* (2013.01); *A63B 2053/005* (2013.01); *A63B 2053/0408* (2013.01); *A63B 2053/0416* (2013.01); *A63B 2053/0491* (2013.01); *A63B 2209/00* (2013.01)

(58) Field of Classification Search

USPC ..... 473/324–350, 287, 290, 390

See application file for complete search history.

(56) References Cited

U.S. PATENT DOCUMENTS

| | | | | |
|---|---|---|---|---|
| 3,955,820 | A * | 5/1976 | Cochran | A63B 53/04 473/337 |
| 3,995,865 | A * | 12/1976 | Cochran | A63B 53/04 473/337 |
| 4,645,207 | A | 2/1987 | Teramoto et al. | |
| 4,687,205 | A * | 8/1987 | Tominaga | A63B 53/04 473/348 |
| 4,754,971 | A | 7/1988 | Kobayashi | |
| 4,874,171 | A | 10/1989 | Ezaki et al. | |
| 4,919,431 | A * | 4/1990 | Antonious | A63B 53/04 473/350 |

(Continued)

FOREIGN PATENT DOCUMENTS

| | | | |
|---|---|---|---|
| JP | 02041182 A | * | 2/1990 |
| JP | 02041182 A | | 2/1990 |

(Continued)

OTHER PUBLICATIONS

Office Action dated Oct. 14, 2016 of co-pending U.S. Appl. No. 14/626,531.

(Continued)

*Primary Examiner* — Alvin A Hunter

(57) ABSTRACT

The present invention generally relates to sets of iron golf clubs, and more particularly, to sets of iron golf clubs that are comprised of significant tungsten weighting to maximize the MOI about an axis through the CG that is parallel to the shaft axis.

15 Claims, 5 Drawing Sheets

(56) References Cited

U.S. PATENT DOCUMENTS 4,938,470 A * 7/1990 Antonious ..... A63B 53/04 473/242
5,011,151 A * 4/1991 Antonious ..... A63B 53/04 473/242
5,026,056 A * 6/1991 McNally ..... A63B 53/04 473/291
5,046,733 A * 9/1991 Antonious ..... A63B 53/04 473/287
5,193,805 A 3/1993 Solheim
5,295,686 A 3/1994 Lundberg
5,333,872 A * 8/1994 Manning ..... A63B 53/04 473/291
5,335,914 A * 8/1994 Long ..... A63B 53/04 473/350
5,421,577 A * 6/1995 Kobayashi ..... A63B 53/04 473/335
5,429,353 A * 7/1995 Hoeflich ..... A63B 53/04 473/350
5,524,880 A 6/1996 Kobayashi
5,564,705 A * 10/1996 Kobayashi ..... A63B 53/04 473/334
5,669,825 A 9/1997 Shira
5,669,826 A 9/1997 Chang
5,722,900 A 3/1998 Sung
5,833,551 A * 11/1998 Vincent ..... A63B 53/04 473/350
5,935,020 A 8/1999 Stites et al.
5,984,803 A 11/1999 Chappell
6,089,990 A 7/2000 Kimura
6,290,607 B1 * 9/2001 Gilbert ..... A63B 53/04 473/291
6,290,609 B1 * 9/2001 Takeda ..... A63B 53/047 473/335
6,482,104 B1 11/2002 Gilbert
6,554,722 B2 4/2003 Erickson
6,602,147 B2 8/2003 Shiraishi
6,623,374 B1 9/2003 Helmstetter et al.
6,685,577 B1 2/2004 Scruggs
6,860,819 B2 3/2005 Gilbert
7,014,568 B2 3/2006 Pelz
7,022,028 B2 4/2006 Nagai et al.
7,108,611 B2 * 9/2006 MacIlraith ..... A63B 53/06 473/288
7,186,187 B2 3/2007 Gilbert et al.
7,232,380 B2 * 6/2007 Nakahara ..... A63B 53/047 473/324
7,281,988 B2 * 10/2007 Hou ..... A63B 53/0466 473/326
7,559,850 B2 7/2009 Gilbert et al.
7,575,523 B2 * 8/2009 Yokota ..... A63B 53/0466 473/332
7,699,716 B2 4/2010 Burnett et al.
7,811,179 B2 10/2010 Roach
7,811,180 B2 10/2010 Roach
7,935,000 B2 5/2011 Stites
7,976,403 B2 * 7/2011 Gilbert ..... A63B 53/0475 473/309
7,980,960 B2 7/2011 Gilbert
8,012,040 B2 * 9/2011 Takechi ..... A63B 53/047 473/329
8,157,673 B2 4/2012 Gilbert
8,235,832 B2 8/2012 Burnett et al.
8,246,487 B1 * 8/2012 Cackett ..... A63B 53/06 473/334
8,302,658 B2 11/2012 Gilbert
8,342,985 B2 * 1/2013 Hirano ..... A63B 53/047 473/350
8,348,785 B2 1/2013 Chen
8,491,407 B2 7/2013 Shear et al.
8,616,997 B2 12/2013 Roach
8,740,721 B2 * 6/2014 Yamamoto ..... A63B 53/047 473/312
8,821,313 B1 9/2014 Dawson
8,870,682 B2 10/2014 Roach
8,911,304 B1 * 12/2014 Dawson ..... A63B 53/0475 473/350
8,926,451 B2 * 1/2015 Deshmukh ..... B21K 17/00 473/349
9,011,270 B2 * 4/2015 Nakano ..... A63B 53/047 473/350
9,387,370 B2 * 7/2016 Hebreo ..... B21K 17/00
9,427,635 B2 8/2016 Ines
9,555,296 B2 * 1/2017 Gilbert ..... A63B 53/047
9,586,104 B2 3/2017 Roach
9,616,304 B2 * 4/2017 Deshmukh ..... B21K 17/00
9,750,994 B2 * 9/2017 Franz ..... A63B 53/047
9,861,863 B1 1/2018 Ivanova
10,004,957 B2 * 6/2018 Franz ..... A63B 53/047
10,010,772 B2 * 7/2018 Ines ..... A63B 53/047
10,052,534 B1 * 8/2018 Ines ..... A63B 53/047
2001/0055996 A1 12/2001 Iwata
2003/0228928 A1 12/2003 Yabu
2008/0161124 A1 7/2008 Kajita
2008/0318705 A1 12/2008 Clausen et al.
2015/0165281 A1 6/2015 Ines et al.

FOREIGN PATENT DOCUMENTS

JP 07067991 A * 3/1995 ..... A63B 53/04
JP 07067991 A 3/1995
JP 10277186 A * 10/1998
JP 10277186 A 10/1998
JP 2001017587 A * 1/2001
JP 2001017587 A 1/2001
JP 2012065803 A * 4/2012 ..... A63B 53/047
JP 2012065803 A 4/2012
JP 2012105821 A 6/2012
JP 2012105821 A * 6/2012 ..... A63B 53/047
JP 2014004367 A 1/2014
JP 2014004367 A * 1/2014 ..... A63B 53/047
JP 2015027373 A * 2/2015 ..... A63B 53/04
JP 2015027373 A 2/2015
JP 2016120264 A * 7/2016
JP 2016120264 A 7/2016
JP 2016179172 A * 10/2016 ..... A63B 53/047
JP 2016179172 A 10/2016

OTHER PUBLICATIONS

Office Action dated Apr. 25, 2016 of co-pending U.S. Appl. No. 14/626,531.

* cited by examiner

WEIGHTED IRON SET

RELATED APPLICATIONS

The present application is a continuation of co-pending U.S. application Ser. No. 15/467,644, filed on Mar. 23, 2017, which is hereby incorporated by reference in its entirety.

TECHNICAL FIELD OF THE INVENTION

The present invention generally relates to sets of iron golf clubs, and more particularly, to sets of iron golf clubs that are comprised of significant tungsten weighting to maximize the MOI about an axis through the CG that is parallel to the shaft axis.

BACKGROUND OF THE INVENTION

In conventional sets of iron golf clubs, each club includes a shaft with a club head attached to one end and a grip attached to the other end. The club head includes a face for striking a golf ball. The angle between the face and a vertical plane is called the loft. In general, the greater the loft of the golf club is in a set, the greater the launch angle and the less distance the golf ball will travel when hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 iron and a 2 iron, but these clubs are generally sold separately from the set. Each iron has a shaft length that usually decreases through the set as the loft for each club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The mid irons, such as the 5 iron, produce an initial trajectory that is between those exhibited by balls hit with the long and short irons.

Iron club heads are categorized into several different types: including muscle back, cavity back and hollow irons. In general, muscle back irons have an evenly distributed weight through the length of the iron from heel to toe. Thus, they have a very solid feel, but low Moment of Inertia, MOI, about the vertical axis extending through the face center. Cavity back irons generally have a thinner section in the center of the back of the club and more mass around the perimeter, thus they are cavity back. The cavity back irons, in general, have a greater MOI about the vertical axis extending through the face center. Finally, hollow irons generally have thinner faces and have mass that is located further back from the face and on the perimeter, creating an even larger MOI than cavity back irons.

SUMMARY OF THE INVENTION

The present invention is directed to a set of golf clubs comprising at least a first club head having a loft between about 15 and 25 degrees (long irons), a second club head having a loft of between about 26 and 35 degrees (mid irons), and a third club head having a loft of about 36 degrees or greater (short irons). In the inventive set, at least the long iron is optimized for Moment of Inertia (MOI) about an axis that is parallel to the shaft axis and extends through the center of gravity (CG). More specifically, the long iron is preferably made of steel and comprises a heel, a toe, a topline, a sole, a hosel defining the shaft axis, a front face and a back wall. The long iron also includes a toe weight member formed of tungsten that is coupled to an upper toe portion of the back wall. Preferably, the toe weight member comprises between about 10% to 30% of the long iron's mass and the center of gravity of the toe weight member is spaced at least about 28 mm, and preferably more than about 30 mm, from the axis that is parallel to the shaft axis that extends through the iron's center of gravity. The long iron also includes a heel weight member formed of tungsten that is coupled a lower portion of the hosel. Preferably, the heel weight member comprises about 5% to 20% of the long iron's mass and the center of gravity of the heel weight member is spaced at least about 28 mm, and preferably more than about 30 mm, from the axis parallel to the shaft axis that extends through the iron's center of gravity.

In a more preferred embodiment, the set includes a mid iron preferably made of steel that also comprises a heel, a toe, a topline, a sole, a hosel defining a shaft axis, a front face and a back wall. Like the long iron, the mid iron preferably comprises a toe weight member formed of tungsten that is coupled to the upper toe portion of the mid iron back wall. The mid iron toe weight member also comprises about 10% to 30% of the mid iron's mass, and the center of gravity of the toe weight member is spaced at least about 28 mm, and preferably more than about 30 mm, from an axis parallel to the shaft axis that extends through the mid iron's center of gravity. The mid iron also preferably includes a heel weight member formed of tungsten that is coupled a lower portion of the hosel. Preferably, the heel weight member comprises about 5% to 20% of the mid iron's mass and the center of gravity of the heel weight member is spaced at least about 28 mm, and preferably more than about 30 mm, from the axis parallel to the shaft axis that extends through the mid iron's center of gravity.

In a preferred embodiment, the toe weight members for the long iron and the mid iron are at least about 30 grams each such that the MOI of the irons about the axis parallel to the shaft axis that extends through the irons' center of gravities are greater than about 200 kg-mm2 and, more preferably, greater than about 230 kg-mm2. Preferably, the long iron has a blade length of about 74 mm to 85 mm and the mid iron has a blade length of about 74 mm to 82 mm.

Another embodiment of the present invention is a set of golf clubs comprising at least a long iron having a loft between about 15 and 25 degrees, a mid iron having a loft of between about 26 and 35 degrees, and a short iron having a loft of about 36 degrees or greater where the long iron is comprised of a heel, a toe, a topline, a sole, a hosel defining a shaft axis, a front face insert and a back wall creating a hollow interior between the front face insert and the back wall. The long iron has a toe weight member formed of tungsten that is coupled into an upper toe portion of the hollow interior. Again, the toe weight member preferably comprises about 10% to 30% of the long iron's mass and the center of gravity of the toe weight member is spaced at least about 28 mm, and preferably more than about 30 mm, from the axis parallel to the shaft axis that extends through the iron's center of gravity. The long iron also is comprised of a heel weight member formed of tungsten that is coupled in the lower heel portion of the hollow interior. Preferably, the heel weight member comprises about 5% to 20% of the long iron's mass and the center of gravity of the heel weight member is spaced at least about 28 mm, and preferably more than about 30 mm, from the axis parallel to the shaft axis that extends through the iron's center of gravity.

In a preferred embodiment of the invention, the set also includes a mid iron that has a body preferably made of steel and comprises a second heel, a second toe, a second topline, a second sole, a second hosel defining a second shaft axis, a second front face insert and a second back wall defining a second hollow interior between the face insert and the back wall. A second toe weight member that is formed of tungsten is coupled to the upper toe portion of the second hollow interior and preferably comprises about 10% to 30% of the second club head mass. Further, the center of gravity of the second toe weight member is also spaced at least about 28 mm, and more preferably, about 30 mm from the axis parallel to the second shaft axis that extends through the mid iron's center of gravity. The mid iron also preferably includes a heel weight member formed of tungsten and coupled in the lower heel portion of the hollow interior. The heel weight member comprises about 5% to 20% of the mid iron's club head mass and its center of gravity is spaced at least about 28 mm, and more preferably, about 30 mm from the axis parallel to the second shaft axis that extends through the mid iron's center of gravity.

In a preferred set, the toe weight members of the long iron and the mid iron are at least about 30 grams such that the Moment of Inertia about the axis parallel to the shaft axis that extends through the iron's center of gravity is greater than about 230 kg-mm2 for both the long iron and the mid iron. Preferably, the long iron has a blade length of about 74 mm to 85 mm and the mid iron has a blade length of about 74 mm to 82 mm and is equal to or shorter than the long iron.

In yet another embodiment of the present inventions a set of golf clubs comprises at least a long iron, a mid iron and a short iron where the long iron has a body made of steel and comprises a heel, a toe, a topline, a sole, a hosel defining a shaft axis, a front face insert and a back wall defining a first hollow interior between the face insert and the back wall. A toe weight member, formed of tungsten, is coupled into an upper toe portion of the first hollow interior and comprises about 10% to 30% of the long iron's club head mass. The center of gravity of the toe weight member is spaced at least about 28 mm, and more preferably, about 30 mm from the axis parallel to the shaft axis that extends through the long iron's center of gravity. In this embodiment, a heel weight member, formed of tungsten, is coupled in a front, lower portion of the hosel. The heel weight member comprises about 5% to 20% of the long iron's club head mass and has a center of gravity that is spaced at least about 28 mm, and more preferably, about 30 mm from the axis parallel to the shaft axis that extends through the long iron's center of gravity.

In a preferred embodiment, the set of irons also includes a mid iron having a body made of steel that comprises a second heel, a second toe, a second topline, a second sole, a second hosel defining a second shaft axis, a second front face insert and a second back wall defining a second hollow interior. The mid iron has a toe weight member formed of tungsten that is coupled to the upper toe portion of the hollow interior and comprises about 10% to 30% of the mid iron's club head mass. The center of gravity of the toe weight member is spaced at least about 28 mm, and more preferably, about 30 mm from the axis parallel to the second shaft axis that extends through the mid iron's center of gravity. The mid iron is further comprised of a heel weight member formed of tungsten and coupled in the front, lower portion of the second hosel. The heel weight member comprises about 5% to 20% of the mid iron's club head mass and has a center of gravity that is spaced at least about 28 mm, and more preferably, about 30 mm from the axis parallel to the second shaft axis that extends through the mid iron's center of gravity.

DETAILED DESCRIPTION OF THE PREFERRED EMBODIMENTS

As illustrated in the accompanying drawings and discussed in detail below, the present invention is directed to an improved set of iron-type golf clubs, wherein the clubs have tungsten weight members that form a significant portion of the club heads' mass and are positioned to maximize the Moment of Inertia of the iron about an axis that is parallel to the shaft axis and extends through the center of gravity.

Figure 1:
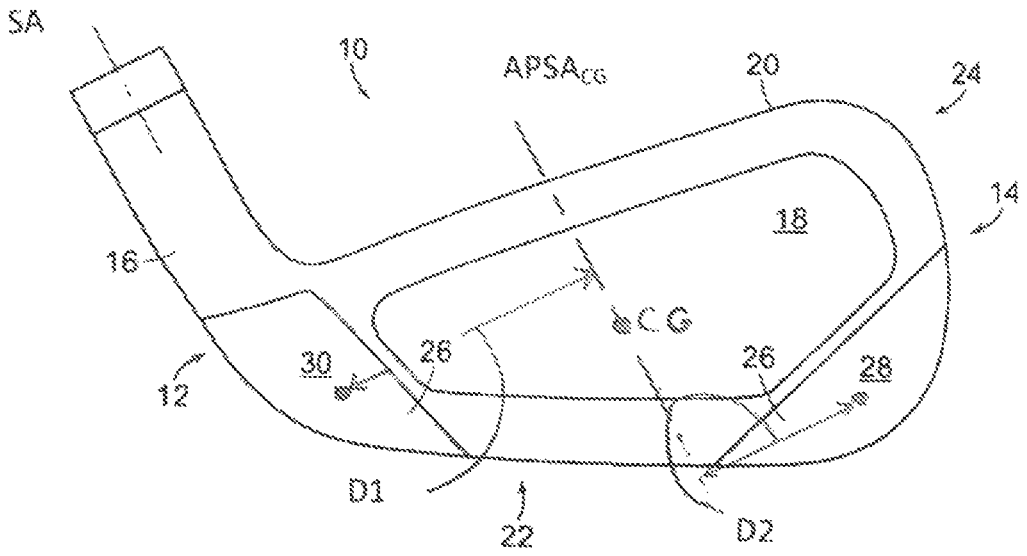
FIG. 1 (PRIOR ART)
FIG. 1 is a back view of an iron according to the prior art.
Figure 2:
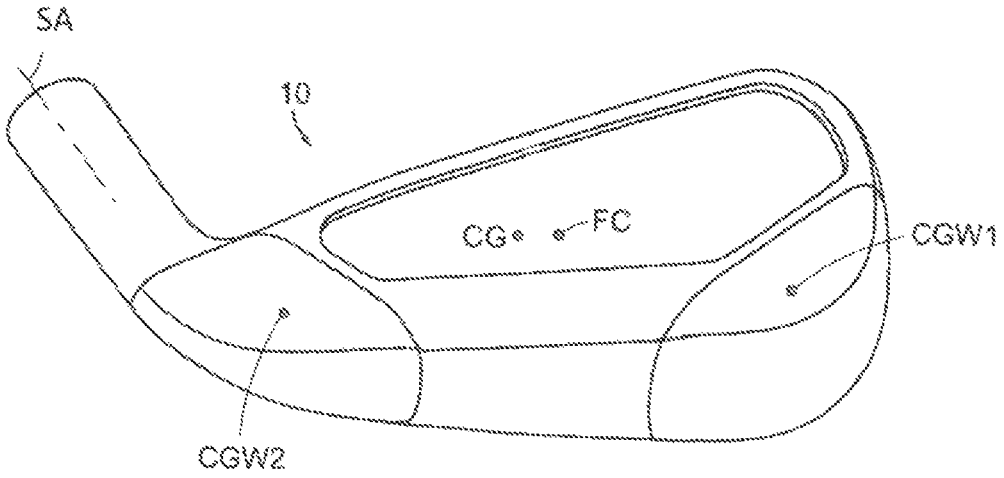
FIG. 2 (PRIOR ART)
FIG. 2 is a perspective view of the iron in FIG. 1.

Referring to FIGS. 1 and 2, a prior art iron 10 has a heel 12, a toe 14, a hosel 16, a back cavity 18 a top line 20 and a sole 22. The iron is comprised of two main components, the main body 24 and the weight members 26. The iron includes a shaft axis SA and an axis, $APSA_{CG}$, that is parallel to the shaft axis and extends through the center of gravity CG. The main body 24 is usually formed from steel. For at least the long irons and mid irons, the weight members 26 include a toe weight member 28 and a heel weight member 30 that are formed from tungsten. Thus, the main body 24 will have a specific gravity of about 7-8 g/cm3 and the weight members 26 will have a specific gravity of about 14-20 g/cm3.

As shown, the distance from the center of gravity for the heel weight member to axis $APSA_{CG}$ is substantially greater than the distance of the toe weight member from the axis $APSA_{CG}$.

Figure 3:
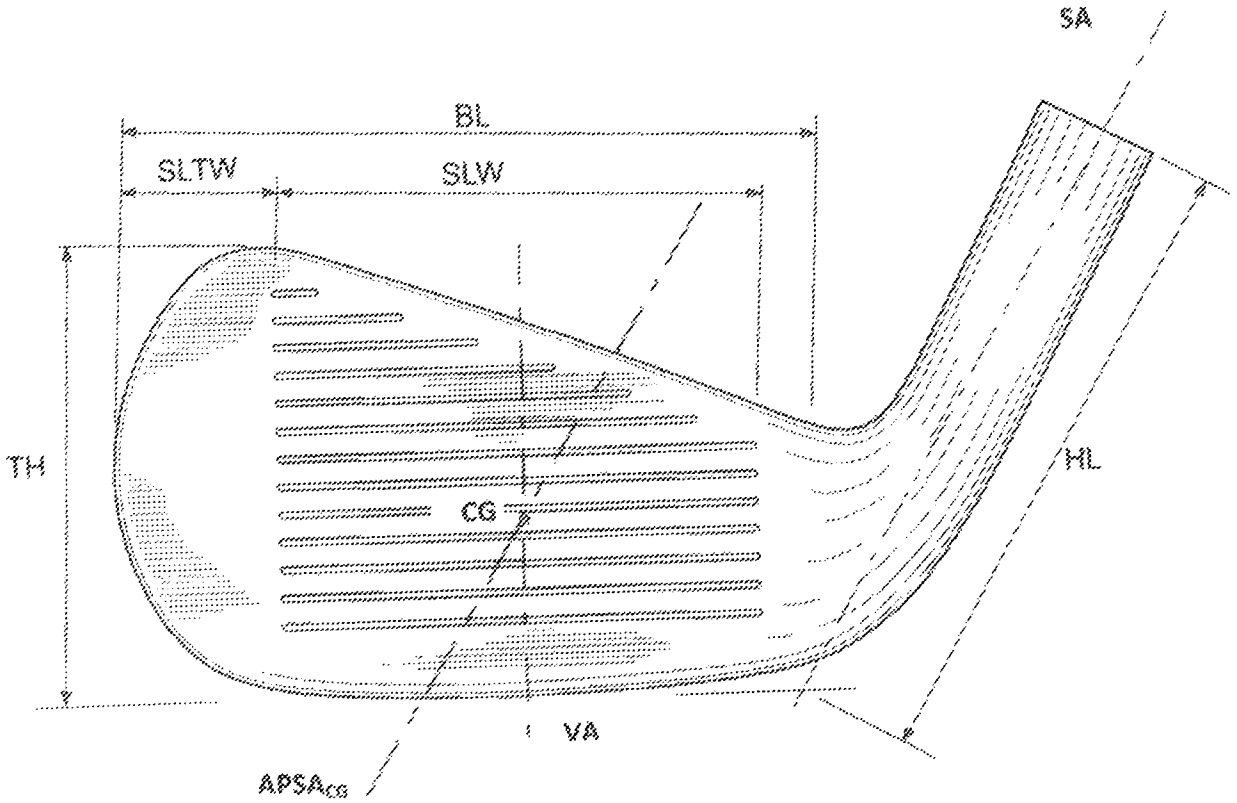
FIG. 3 is a front view of a long iron according to the present invention.

As shown in FIG. 3 the present invention includes a set of irons that have a Blade Length (BL) of each club within the set. The BL is defined at the length from the hosel axis (HA) intersection with the ground plane to the end of the toe. The irons also have a Toe Height (TH) that progressively increases through the set. Thus, the TH of the mid iron is greater than the TH of the long iron and the TH of the short iron is greater than the TH of the mid iron and the long iron. The TH is defined as the maximum length from the leading edge to the top of the toe in the plane parallel to the face plane and perpendicular to the scorelines. Preferably, the TH increases by about at least 0.3 mm per club, and most preferably at least 0.4 mm per club. Also, the TH preferably increases at least 1 mm per club (or about 4 degrees of loft) for the short irons and only 0.3-0.6 mm per club for the long and mid irons.

Furthermore, the irons in the set have a scoreline width (SLW) that progressively decreases in length from long irons to short irons in the set and can have a scoreline to toe width (SLTW) that progressively increases from long irons to short irons within the set. More particularly, in a preferred embodiment, the SLW decreases by at least about 0.1 mm per club (or per 4 degrees of loft). Thus, the SLW for the long iron is greater than the SLW for the mid iron and the SLW for the mid iron is greater than the SLW for the short iron.

Each of the irons has a center of gravity, CG, a hosel length, HL, and a shaft axis, SA, that is also defined by the hosel bore. The clubs according to the present invention are optimized for a maximum moment of inertia, MOI, about an axis that extends parallel to the SA and extends through the CG, $APSA_{CG}$. The CG of the club is preferably very close to the center of the score lines, that is ½ SLW from the score line edges. In a more preferred embodiment, the long irons have a CG that is at least 0.45*SLW from the heel edge of the scorelines. In an even more preferred embodiment, the mid irons also have a CG that is at least 0.45*SLW from the heel edge of the scorelines.

Figure 4:
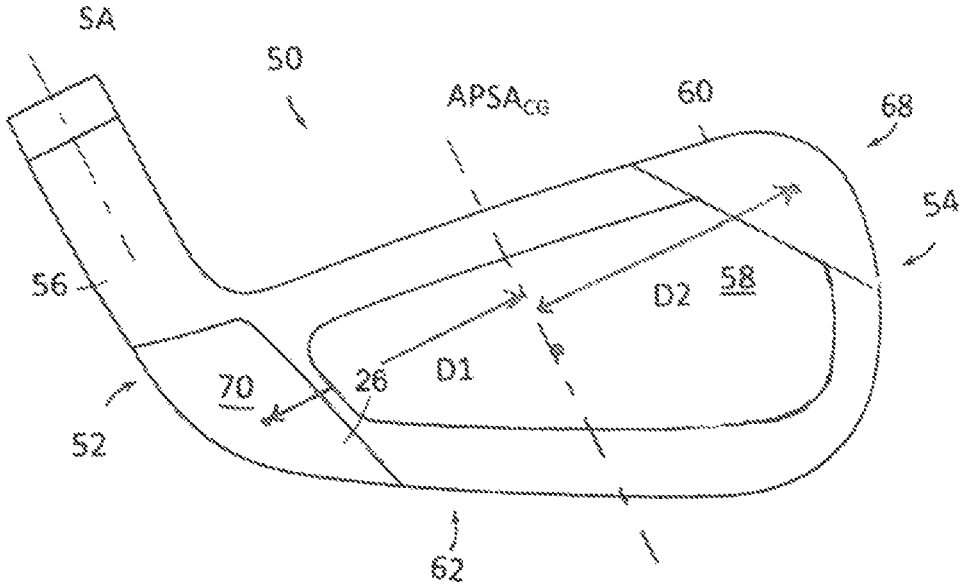
FIG. 4 is a back view of a long iron according to the present invention.
Figure 5:
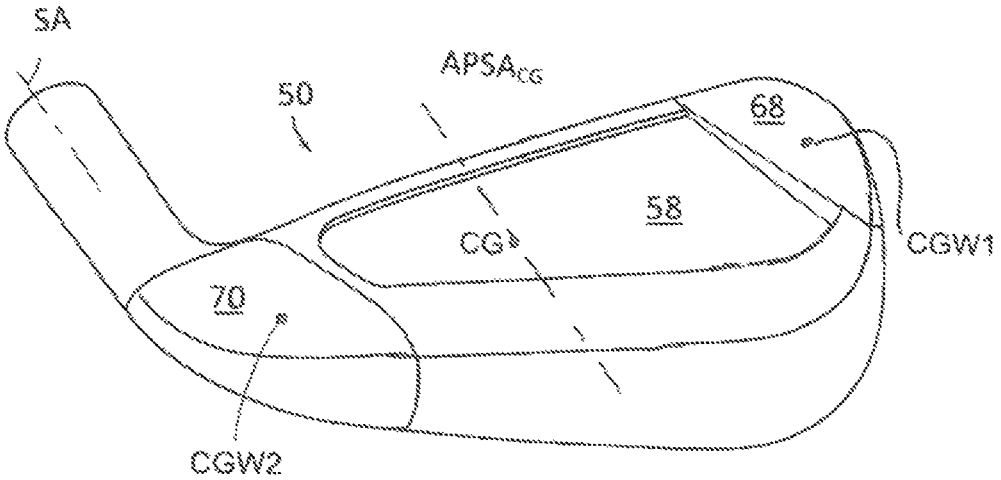
FIG. 5 is a perspective view of the iron in FIG. 4.

Referring to FIGS. 4 and 5, a long iron 50 according to the present invention has a loft between about 15 and 25 degrees. The long iron 50 is preferably made of steel and comprises a heel 52, a toe 54, a topline 60, a sole 62, a hosel 56 that defines the shaft axis SA, and a back wall 58. The long iron 50 also includes a toe weight member 68 formed of tungsten that is coupled to an upper toe portion of the back wall 58. Preferably, the toe weight member 68 comprises between about 10% to 30% of the long iron's mass and the center of gravity of the toe weight member CGW1 is spaced a distance D2 that is at least about 28 mm, and more preferably, about 30 mm from the axis that is parallel to the shaft axis that extends through the iron's center of gravity, $APSA_{CG}$. The long iron 50 includes a heel weight member 70 that is also formed of tungsten. The heel weight 70 is preferably coupled a lower portion of the hosel 56 or the lower-heel portion of the back wall 58. Preferably, the heel weight member 70 comprises about 5% to 20% of the long iron's mass and the center of gravity of the heel weight member CGW2 is spaced a distance D1 that is at least about 28 mm, and more preferably, about 30 mm from the axis $APSA_{CG}$. Preferably, D1 and D2 are approximately equal, i.e., they are within a few millimeters of each other, and more preferably, D1 and D2 are within about 10% of each other. Further, D1 and D2 are both greater than about 30% of the blade length BL.

In order to maximize the MOI about the $APSA_{CG}$, it is important to incorporate a significant amount of mass at the upper-toe location and lower-heel location. Thus, the toe weight member 68 and the heel weight member 70 should be constructed out of tungsten having a specific gravity of greater than 14 g/cm$^3$. More preferably, the weight members are formed of a tungsten having a specific gravity of 17 g/cm$^3$ or greater. The greater the specific gravity of the weight members, the further the CGW1 and CGW2 can be from the $APSA_{CG}$.

In the preferred embodiment of the long iron and the mid irons, the mass of the toe weight member 68 is about 30 grams or greater and is located more than about 28 mm, and more preferably, about 30 mm from the $APSA_{CG}$. The mass of the heel weight member 70 is less for the long irons than in the mid iron in the most preferred set. However, the toe weight member 68 and the heel weight member 70 have about the same mass for the mid irons. Moreover, the distance D1 and the distance D2 are approximately equal, i.e., they are within 3 to 4 millimeters of each other, for the long irons and the mid irons. Still further, the distance D1 plus the distance D2 is greater than about 70%, and more preferably, about 75% of the blade length BL.

Tables I (mass properties) and II (club properties) provide exemplary, non-limiting dimensions for the various measurements of clubs according to the Example of the invention shown in FIGS. 4 and 5. It is fully intended that all of the dimensions set forth below can be adjusted such that the overall objective of the individual irons is met.

TABLE I

| | Club Number | | | | | | | | |
|---|---|---|---|---|---|---|---|---|---|
| | 2 | 3 | 4 | 5 | 6 | 7 | 8 | 9 | P |
| loft | 17 | 21 | 24 | 27 | 30 | 34 | 38 | 42 | 46 |
| Total Mass (g) | 234 | 234 | 242 | 249 | 254 | 263 | 270 | 278 | 283 |
| Toe W (g) | 32 | 32 | 36 | 33 | 30 | 27 | | | |
| Heel W (g) | 14 | 14 | 24 | 26 | 30 | 32 | | | |
| D1 | 33 | 33 | 34 | 34 | 35 | 35 | | | |
| D2 | 33 | 33 | 34 | 34 | 35 | 35 | | | |

TABLE II

| | Club Number | | | | | | | | |
|---|---|---|---|---|---|---|---|---|---|
| | 2 | 3 | 4 | 5 | 6 | 7 | 8 | 9 | P |
| Blade Length (mm) | 78 | 78 | 78 | 78 | 78 | 78 | 78 | 78 | 78 |
| Toe Height (mm) | 52 | 52 | 52 | 53 | 53 | 53 | 54 | 55 | 56 |
| Scoreline Width (mm) | 53 | 53 | 53 | 53 | 53 | 52 | 52 | 52 | 52 |
| Scoreline to Toe (mm) | 17 | 17 | 18 | 18 | 18 | 18 | 18 | 19 | 19 |
| Hosel Length (mm) | 63 | 63 | 63 | 63 | 63 | 64 | 68 | 72 | 75 |
| Sole Width (mm) | 19 | 19 | 18 | 18 | 18 | 17 | 17 | 16 | 15 |

Figure 6:
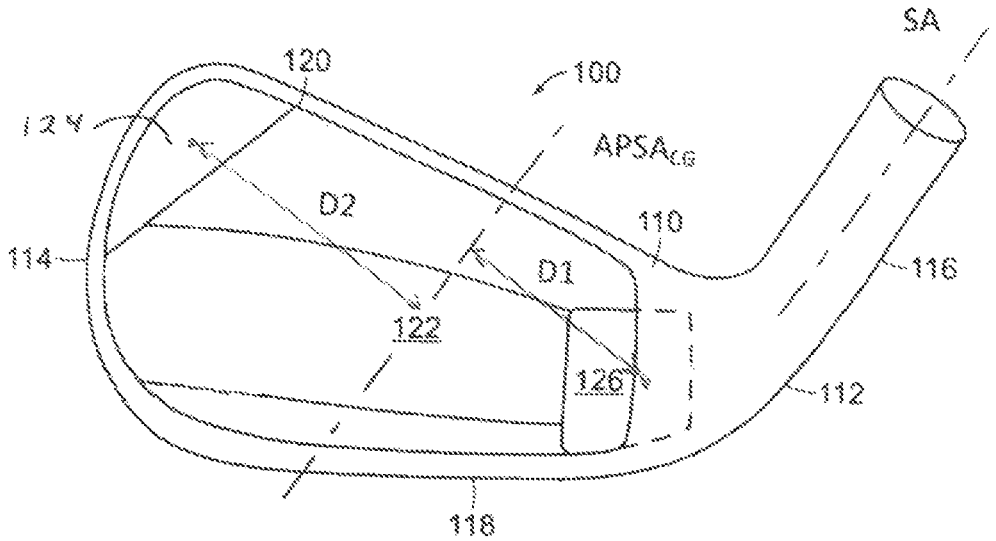
FIG. 6 is a front view of another long iron according to the present invention.
Figure 7:
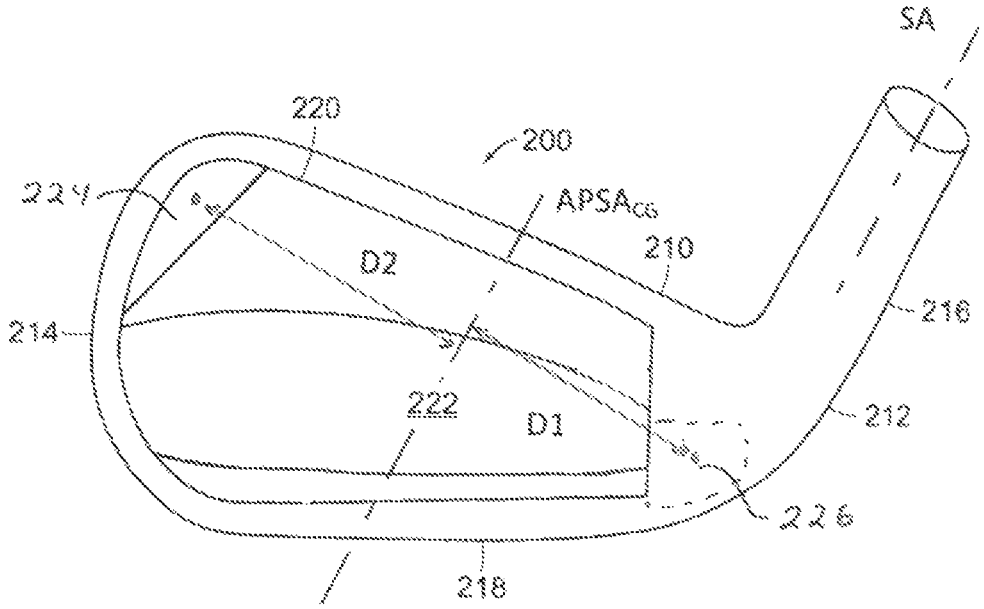
FIG. 7 is a front view of a mid iron according to the present invention.

As shown in FIGS. 6-7 and set forth in the Tables III and IV below, another embodiment of the present invention includes a hollow long iron 100 and a hollow mid iron 200. In FIG. 6, the long iron 100 includes a body member 110, heel 112, a toe 114, a hosel 116 and a sole 118. The iron body 110 includes an insert aperture 120 and a hollow portion 122. A face insert, not shown, is welded to the insert aperture 120 to enclose the hollow portion 122. Both the body member 110 and the face insert are preferably formed of steel and have a specific gravity of about 7 to 8 g/cm$^3$. The face insert is preferably formed from a high strength steel and has a thickness of less than about 2 mm. Inside the hollow portion 122, a tungsten toe weight member 124 and a tungsten heel weight member 126 are located proximate an upper portion of the toe 114 and a lower portion of the heel 112, respectively, to create a high moment of inertia about the $APSA_{CG}$.

As shown in Table III below, the long irons preferably have a mass of about 220 grams to 250 grams. In the long irons 100, the toe weight member 124 preferably has a mass of about 30 to 55 grams, and preferably about 10% to 30% of the club head mass. Preferably, the toe weight member 124 mass increases with each club by about 5 grams per club. The heel weight member 126 is preferably about 25 grams to 40 grams, and preferably comprises about 5% to 20% of the club head mass. Preferably, the heel weight members decrease by about 1 or 2 grams per club. More preferably, the tungsten mass of the toe weight member 124 and the heel weight member 126 combined are at least about 25% of the total club head mass and at least about 15% of the total club head solid volume. More particularly, the toe weight member 124 and the heel weight member 126 comprise about 30% of the total mass and more than about 20% of the total solid volume. Preferably, the toe weight member 124 has greater mass than the heel weight member 126. Preferably, the toe weight member and the heel weight member are formed of tungsten have a specific gravity of greater than 14 g/cm$^3$, and more preferably, greater than or equal to about 17 g/cm$^3$. Moreover, in order to maximize the MOI about the $APSA_{CG}$, the toe weight member 124 is coupled into the upper toe portion of hollow portion 122 and the heel weight member 126 is coupled to the lower heel portion of the hollow portion 122 such that the center of gravity of the weight members 124 and 126 are spaced a distance of at least about 28 mm, and more preferably, about 30 mm from the $APSA_{CG}$. Further, the toe weight member 124 is coupled into the upper toe portion of hollow portion 122 and the heel weight member 126 is coupled to the lower heel portion of the hollow portion 122 such that the center of gravity of the weight members 124 and 126 are spaced a distance, D2 and D1 respectively, of at least about 30% of the blade length from the $APSA_{CG}$. Moreover, D1 plus D2 is preferably greater than about 70%, and more preferably, about 75% of the blade length.

TABLE III

| | Club Number | | | | | | | | |
|---|---|---|---|---|---|---|---|---|---|
| | 2 | 3 | 4 | 5 | 6 | 7 | 8 | 9 | P |
| loft | 17 | 20 | 23 | 26 | 29 | 33 | 37 | 41 | 45 |
| Total Mass (g) | 234 | 240 | 245 | 252 | 260 | 267 | 274 | 282 | 286 |
| Toe W (g) | 38 | 45 | 50 | 55 | 61 | 60 | 61 | 63 | |
| Heel W (g) | 34 | 32 | 31 | 31 | 20 | 20 | | | |
| D1 | 30 | 30 | 31 | 32 | 32 | 32 | | | |
| D2 | 31 | 31 | 31 | 32 | 32 | 33 | 33 | 33 | |

TABLE IV

| | Club Number | | | | | | | | |
|---|---|---|---|---|---|---|---|---|---|
| | 2 | 3 | 4 | 5 | 6 | 7 | 8 | 9 | P |
| Blade Length (mm) | 78 | 78 | 78 | 78 | 78 | 78 | 78 | 78 | 78 |
| Toe Height (mm) | 52 | 52 | 53 | 53 | 54 | 54 | 55 | 55 | 56 |
| Scoreline Width (mm) | 53 | 53 | 53 | 53 | 53 | 52 | 52 | 52 | 52 |
| Scoreline to Toe (mm) | 17 | 17 | 18 | 18 | 18 | 18 | 18 | 19 | 19 |
| Hosel Length (mm) | 62 | 63 | 64 | 65 | 66 | 67 | 68 | 69 | 70 |
| Sole Width (mm) | 19 | 19 | 19 | 19 | 18 | 17 | 17 | 16 | 15 |

As shown in FIG. 7 and as set forth in Tables III and IV above, a set of irons according to the present invention includes a mid iron 200 that includes a body member 210, heel 212, a toe 214, a hosel 216 and a sole 218. The iron body 210 includes an insert aperture 220 and a hollow portion 222. A face insert, not shown, is welded to the insert aperture 220 to enclose the hollow portion 222. Both the body member 210 and the face insert are preferably formed of steel and have a specific gravity of about 7 to 8 g/cm$^3$. Inside the hollow portion 222, a tungsten toe weight member 224 and a tungsten heel weight member 226 are located proximate an upper portion of the toe 214 and lower portion on the heel 212, respectively, to create a high moment of inertia about the $APSA_{CG}$. More preferably, the toe weight member 224 of the mid iron is located a distance D2 from the $APSA_{CG}$ that is greater than about 28 mm, and more preferably, about 30 mm and is approximately the same or greater than the distance D2 for the long irons. The heel weight member 226 is located a distance D1 from the $APSA_{CG}$ that is greater than about 28 mm, and more preferably, about 30 mm and is preferably located a distance D1 from the $APSA_{CG}$ that is greater than or equal to D1 for the long irons. For the mid irons, D1 and D2 are, preferably, approximately equal and D1 plus D2 is preferably greater than about 70%, and more preferably, about 75% of the blade length.

As shown in Table III above, the mid irons 200 preferably have a mass of about 250 grams to about 270 grams. In the mid irons 200, the toe weight member 224 preferably has a mass of about 40 to about 60 grams, and preferably, comprises about 10% to 30% of the overall club head mass. Preferably, the mass of the toe weight member 224 increases with an increase in club loft within the set or remains approximately equal. The heel weight member 226 is preferably about 15 grams to about 40 grams, and preferably, comprises about 5% to 20% of the overall club head mass. Preferably, the mass of the heel weight members 226 decreases with an increase in club loft within the set or remains approximately equal. Preferably, the tungsten mass of the toe weight member 224 and the heel weight member 226 combined are at least about 15% of the total club head mass and at least about 10% of the total club head solid volume. More particularly, the toe weight member 224 and the heel weight member 226 comprise about 20% to 25% of the total mass and more than about 10% of the total solid volume. Preferably, the toe weight member 224 has greater mass than the heel weight member 226. Preferably, the toe weight member and the heel weight member are formed of tungsten have a specific gravity of greater than 14 g/cm$^3$, an more preferably greater than or equal to about 17 g/cm$^3$.

Figure 8:
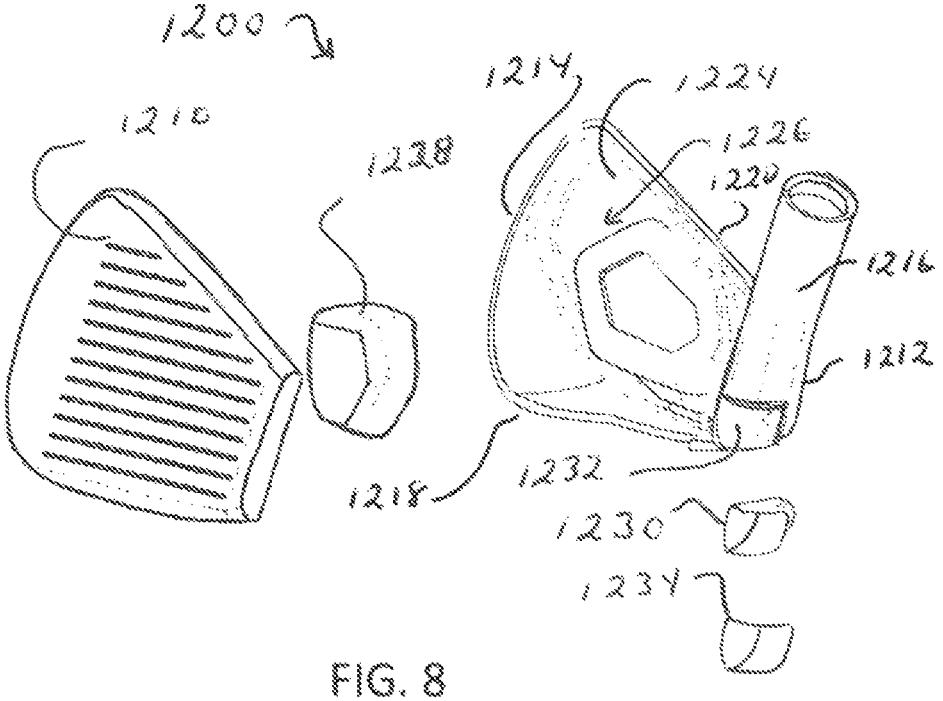
FIG. 8 is an exploded view of another embodiment of a long iron according to the present invention.

Referring to FIG. 8, another embodiment of the present invention is a set of golf clubs comprising at least a long iron having a loft between about 15 and 25 degrees and a first club head mass, a mid iron having a loft of between about 26 and 35 degrees and a second club head mass, and a short iron having a loft of about 36 degrees or greater and a third club head mass. The long iron, for example, is preferably formed from steel and comprises a body 1200 that comprises a heel 1212, a toe 1214, a topline 1220, a sole 1218, and a hosel 1216. A front face insert 1210 and a back wall 1224 form a hollow cavity 1226 therebetween.

Preferably, the iron body 1220 is cast with the main cavity 1226 and the hosel cavity 1232. The front face insert 1210 is preferably stamped from a high strength sheet metal and is welded to the body after a toe weight member 1228 is secured with in the hollow cavity 1226. A heel weight member 1230 is inserted into the face side of the hosel cavity 1232 and then a hosel cover member 1234 is welded to the front portion of the hosel 1216 to secure the heel weight member 1230 within the hosel cavity 1232.

The toe weight member 1228 is formed of tungsten and is coupled to an upper toe portion of the hollow cavity 1226. Preferably, as set forth in Table V below, the toe weight member 1228 is greater than about 65 grams and comprises about 10% to 30%, and more preferably about 20% to 30% of the long iron club head mass. The long iron head 1200 further comprises the heel weight member 1230 that is also formed of tungsten. The heel weight member 1230 is about 10 to 20 grams and comprises about 5% to 20% of the overall club head mass. Preferably, the heel weight member 1230 is coupled into the hosel cavity 1232 formed in the front, lower portion of the hosel 1216. In this embodiment, the heel weight member 1230 is preferably secured in the hosel cavity 1232 by a cover member 1234 that forms at least a front portion of the hosel 1216. The toe weight member 1228 and the heel weight member 1230 are both formed of tungsten and preferably have a specific gravity of greater than 14 g/cm$^3$, and more preferably greater than about 17 g/cm$^3$. The hosel cover member is preferably formed of a nickel alloy having a specific gravity of between about 8 g/cm$^3$ and about 14 g/cm$^3$.

In the preferred set, the mid iron has the same or similar construction as the long iron, and thus, similarly comprises a steel, hollow body with a heel, a toe, a topline, a sole, and a hosel. As set forth in Table V below, the toe weight member for at least one of the mid irons is also formed of greater than 65 grams of tungsten and comprises about 20% to 30% of the mid iron head mass.

In the set of irons according to this embodiment the present invention, the iron 1200 is preferably formed of steel and has a specific gravity of about 7 to 8 g/cm$^3$. The tungsten toe weight member 1228 and a tungsten heel weight member 1230 are again located proximate an upper portion of the toe 1214 and lower portion on the heel 1212, respectively, to create a high moment of inertia about the $APSA_{CG}$. More preferably, the toe weight member 1228 of the iron is located a distance D2 from the $APSA_{CG}$ that is greater than about 28 mm, and more preferably, about 30 mm. The heel weight member 1230 is located a distance D1 from the $APSA_{CG}$ that is greater than about 28 mm, and more preferably, about 30 mm. For the iron 1200, D1 and D2 are, preferably, approximately equal and D1 plus D2 is preferably greater than about 70%, and more preferably, about 75% of the blade length.

The club heads according to the present invention have high MOI about the $APSA_{CG}$. Because they have such large tungsten weight members, the MOI about the $APSA_{CG}$ is greater than about 230 kg-mm$^2$, and more preferably greater than about 250 kg-mm$^2$, for the long iron and mid iron. Still further, the irons in the preferred set as presented in Tables V and VI below are not oversized. That is, the blade length is less than about 82 mm. Thus, the MOI about the $APSA_{CG}$ to blade length ratio is very high. More particularly, the MOI about the $APSA_{CG}$ to blade length ratio is greater than about 3 kg-mm, and more preferably, between about 3.1 kg-mm and 3.5 kg-mm.

Moreover, because the mid irons and the long irons are hollow, the Center of Gravity is relatively deep. More particularly, the Center of Gravity depth from the face center, CGzFC, is preferably greater than 6 mm for all of the irons. In a preferred embodiment, the CGzFC can be around 8 mm for the long irons. Preferably, the CGzFC is between about 1/15 and about 1/10 of the blade length for the long iron.

TABLE V

| | Club Number | | | | | | | |
|---|---|---|---|---|---|---|---|---|
| | 3 | 4 | 5 | 6 | 7 | 8 | 9 | P |
| loft | 19 | 22 | 25 | 28 | 31 | 35 | 39 | 43 |
| Total Mass (g) | 239 | 247 | 254 | 261 | 268 | 274 | 284 | 286 |
| Body Mass (g) | 85 | 86 | 87 | 118 | 261 | 267 | 278 | 280 |
| Face Mass (g) | 58 | 58 | 58 | 56 | | | | |
| Toe W (g) | 67 | 74 | 77 | 73 | | | | |
| Heel W (g) | 14 | 15 | 18 | | | | | |
| Steel Mass % | 60 | 58 | 57 | 67 | | | | |
| W Mass % | 34 | 36 | 37 | 28 | | | | |

TABLE VI

| | Club Number | | | | | | | |
|---|---|---|---|---|---|---|---|---|
| | 3 | 4 | 5 | 6 | 7 | 8 | 9 | P |
| Blade Length (mm) | 81 | 81 | 81 | 80 | 80 | 80 | 80 | 80 |
| Toe Height (mm) | 31 | 31.5 | 32 | 32.3 | 32.7 | 33.3 | 34 | 34.5 |
| Scoreline Width (mm) | 54.5 | 54.3 | 54.1 | 54 | 53.8 | 53.6 | 53.3 | 53.1 |
| Sole Width Center (mm) | 16.8 | 16.3 | 15.8 | 15.3 | 14.8 | 14.65 | 14.5 | 14.35 |

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

What is claimed is:

1. A set of hollow golf clubs comprising at least a first club head having a loft between about 15 and 25 degrees and a first club head mass, a second club head having a loft of between about 26 and 35 degrees and a second club head mass, and a third club head having a loft of about 36 degrees or greater and a third club head mass, the first club head having a first center of gravity and comprising:

a body made of steel comprising a heel, a toe, a topline, a sole, a hosel defining a shaft axis, a front face insert and a back wall defining a first enclosed hollow interior, a toe weight member formed of tungsten and coupled into an upper toe portion of the first enclosed hollow interior that comprises about 10% to 30% of the first club head mass, wherein a center of gravity of the toe weight member is spaced at least about 28 mm from an axis parallel to the shaft axis that extends through the first center of gravity; and a heel weight member formed of tungsten, having a mass of 25 to 40 grams, and coupled in a lower heel portion of the first enclosed hollow interior, the heel weight member comprising about 5% to 20% of the first club head mass, wherein a center of gravity of the heel weight member is spaced at least about 28 mm from the axis parallel to the shaft axis that extends through the first center of gravity, and wherein the second club head has a second center of gravity and comprises:

a second body made of steel comprising a second heel, a second toe, a second topline, a second sole, a second hosel defining a second shaft axis, a second front face insert and a second back wall defining a second enclosed hollow interior, a second toe weight member formed of tungsten and coupled to a second upper toe portion of the second enclosed hollow interior that comprises about 10% about 30% of the second club head mass, wherein a second center of gravity of the second toe weight member is spaced at least about 28 mm from a second axis parallel to the second shaft axis that extends through the second center of gravity; and a second heel weight member formed of tungsten, having a mass of between 15 to 40 grams, and coupled in a second lower portion of the second enclosed hollow interior, the second heel weight member comprising about 5% to 20% of the second club head mass, wherein a second center of gravity of the second heel weight member is spaced at least about 28 mm from the second axis parallel to the second shaft axis that extends through the second center of gravity.

2. The set of golf clubs of claim 1, wherein the first toe weight member and the second toe weight member are at least 30 grams.

3. The set of golf clubs of claim 1, wherein the first club head has a Moment of Inertia about the axis parallel to the shaft axis that extends through the first center of gravity of greater than about 230 kg-mm$^2$.

4. The set of golf clubs of claim 3, wherein the second club head has a Moment of Inertia about the second axis parallel to the second shaft axis that extends through the second center of gravity of greater than about 230 kg-mm$^2$.

5. The set of golf clubs of claim 1, wherein the first club head has a blade length of about 74 mm to 85 mm.

6. The set of golf clubs of claim 5, wherein the second club head has a blade length of about 74 mm to 82 mm and is less than the blade length of the first club.

7. The set of golf clubs of claim 1, wherein the first club head has a blade length of about 74 mm to 85 mm and the center of gravity of the toe weight member and the center of gravity of the heel weight member are both spaced a distance of at least about 30% of the blade length from the axis parallel to the shaft axis that extends through the first center of gravity.

8. The set of golf clubs of claim 1, wherein the first club head has a blade length of about 74 mm to 85 mm and D1 plus D2 is greater than about 70% of the blade length, wherein D2 is a distance between the center of gravity of the toe weight member and the axis parallel to the shaft axis that extends through the first center of gravity and D1 is a distance between the center of gravity of the heel weight member and the axis parallel to the shaft axis that extends through the first center of gravity.

9. A set of golf clubs comprising at least a first club head having a loft between about 15 and 25 degrees and a first club head mass, a second club head having a loft of between about 26 and 35 degrees and a second club head mass, and a third club head having a loft of about 36 degrees or greater and a third club head mass, the first club head having a first center of gravity and comprising:

a body made of steel comprising a heel, a toe, a topline, a sole, a hosel defining a shaft axis, a front face insert and a back wall defining a first enclosed hollow interior, a toe weight member formed of tungsten, having a mass of greater than 65 grams, and coupled into an upper toe portion of the first enclosed hollow interior that comprises about 10% to 30% of the first club head mass, wherein a center of gravity of the toe weight member is spaced at least about 28 mm from an axis parallel to the shaft axis that extends through the first center of gravity; and a heel weight member formed of tungsten, having a mass of between 10 to 20 grams, and coupled in a lower portion of the first hosel, the heel weight member comprising about 5% to 20% of the first club head mass, wherein a center of gravity of the heel weight member is spaced at least about 28 mm from the axis parallel to the shaft axis that extends through the first center of gravity.

10. The set of golf clubs of claim 9, wherein the second club head has a second center of gravity and comprises:

a second body made of steel comprising a second heel, a second toe, a second topline, a second sole, a second hosel defining a second shaft axis, a second front face insert and a second back wall defining a second enclosed hollow interior, a second toe weight member formed of tungsten, having a mass of greater than 65 grams, and coupled to a second upper toe portion of the second enclosed hollow interior that comprises about 10% about 30% of the second club head mass, wherein a second center of gravity of the second toe weight member is spaced at least about 28 mm from a second axis parallel to the second shaft axis that extends through the second center of gravity; and a second heel weight member formed of tungsten and coupled in a second lower portion of the second hosel, the second heel weight member comprising about 5% to 20% of the second club head mass, wherein a second center of gravity of the second heel weight member is spaced at least about 28 mm from the second axis parallel to the second shaft axis that extends through the second center of gravity.

11. The set of golf clubs of claim 9, wherein the first club head has a Moment of Inertia about the axis parallel to the shaft axis that extends through the first center of gravity of greater than about 230 kg-mm$^2$.

12. The set of golf clubs of claim 10, wherein the second club head has a Moment of Inertia about the second axis parallel to the second shaft axis that extends through the second center of gravity of greater than about 230 kg-mm$^2$.

13. The set of golf clubs of claim 9, wherein the first club head has a blade length of about 74 mm to 85 mm.

14. The set of golf clubs of claim 10, wherein the second club head has a blade length of about 74 mm to 82 mm.

15. The set of clubs of claim 9, where the first club has a Moment of Inertia about the axis parallel to the shaft axis that extends through the first center of gravity to blade length ratio that is between about 3.1 kg-mm and 3.5 kg-mm.

* * * * *